US005546153A

United States Patent [19]

Earle et al.

[11] Patent Number: 5,546,153

[45] Date of Patent: Aug. 13, 1996

[54] LIQUID TRANSFER SYSTEM AND METHOD

[75] Inventors: Anthony Earle, Harrow Weald; Edward C. T. S. Glover, London; Michael Ridgway, Tring, all of England

[73] Assignee: Eastman Kodak Company, Rochester, N.Y.

[21] Appl. No.: 372,070

[22] Filed: Jan. 12, 1995

[30] Foreign Application Priority Data

Jan. 14, 1994 [GB] United Kingdom ..... 9400667

[51] Int. Cl.[6] ..... G03D 3/02; G03D 13/00

[52] U.S. Cl. ..... 354/298; 354/324; 137/454

[58] Field of Search ..... 354/322–324, 354/328, 298; 137/195, 454, 453, 386; 222/86, 80, 82, 63; 366/153, 177, 167; 134/64 P, 122 P

[56] References Cited

U.S. PATENT DOCUMENTS

| | | | |
|---|---|---|---|
| 3,911,460 | 10/1975 | Lasky et al. | 354/328 |
| 4,012,753 | 3/1977 | Schmidt | 354/316 |
| 4,586,805 | 5/1986 | Bockemuhlsimon | 354/323 |
| 4,629,303 | 12/1986 | Vermarien | 354/324 |
| 4,779,640 | 10/1988 | Cummings | 137/195 |

OTHER PUBLICATIONS

Patent Abstracts of Japan, vol. 6, No. 18 (P–100), 02 Feb. 1982 & JP–A–56 142532 (Ricoh Co. Ltd.) 06 Nov. 1981.

*Primary Examiner*—D. Rutledge
*Attorney, Agent, or Firm*—Frank Pincelli

[57] ABSTRACT

A liquid transfer system particularly suited for transferring a processing chemical between a reservoir and a tank in a photographic processing apparatus, comprises a liquid reservoir having an outlet which is connectable to the tank in the processing apparatus. The reservoir is connected to a source of pressurized gas which forces liquid to be transferred from the reservoir to the tank. The outlet of the reservoir is provided with a valve arrangement which serves to close the reservoir outlet when the liquid level in the reservoir drops below a predetermined level and prevents pressurized gas from escaping from the reservoir.

15 Claims, 1 Drawing Sheet

LIQUID TRANSFER SYSTEM AND METHOD

FIELD OF THE INVENTION

The present invention relates to a liquid transfer system and method and, more particularly, but not exclusively, to a liquid transfer system and method for use with a photographic processing apparatus in order to transfer photographic processing solution to and from a tank in the apparatus.

BACKGROUND OF THE INVENTION

During processing, photographic material is usually immersed in a number of processing solutions in a predetermined sequence. This may be effected either by placing the photographic material in a single tank and sequentially filling the tank with the various processing solutions or by filling a number of tanks with the different processing solutions and conveying the photographic material from one tank to the next. Examples of the processing solutions include developing solution, fixing solution, and washing solution.

Regardless of which processing method is adopted it is always necessary to fill one or more tanks in a photographic processing apparatus with the appropriate solution before the material is processed and then to empty the or each tank either so that it can be refilled with a different solution or to prevent aerial degradation if the solution is not going to be used for some time.

The processing solutions comprise chemicals which can, in some cases, be hazardous to handle. It is therefore desirable to eliminate or reduce to a minimum the handling of the solutions by persons operating the photographic processing apparatus.

SUMMARY OF THE INVENTION

The present invention seeks to provide a liquid transfer system and method which may be used, among other things, for transferring a photographic processing solution to and from a tank in a photographic processing apparatus and which address the concerns outlined above.

According to one aspect, this invention provides a liquid transfer system for transferring liquid between a reservoir and a tank in a processing apparatus, the system comprising a liquid reservoir, the reservoir having an outlet, means for connecting the reservoir outlet to a tank in a processing apparatus, means for pressurizing the reservoir to transfer liquid from the reservoir to the tank, the outlet of the reservoir being provided with a valve arrangement, the valve arrangement closing the reservoir outlet when the liquid level in the reservoir drops below a predetermined level.

Preferably, the means for pressurizing the reservoir comprises a supply of pressurized gas connected to a space in the reservoir above the liquid contained therein, the pressurized gas supply forcing liquid from the reservoir, the valve arrangement acting to close the reservoir outlet before all of the liquid has been transferred from the reservoir thereby preventing pressurized gas from escaping from the reservoir.

Conveniently, the valve arrangement incorporates a float element and movement of the float element acting to close the reservoir outlet when the liquid level in the reservoir drops below said predetermined level.

In one arrangement, the float element engages part of the reservoir outlet in order to close the outlet. In this case the outlet may be surrounded by a sealing ring, the float element engaging the sealing ring to close the outlet. Conveniently, the float element is held in position adjacent the outlet by a retaining grid mounted in the reservoir.

In another arrangement, the float element is connected to a sliding valve member positioned adjacent the reservoir outlet, movement of the float element resulting in movement of the valve member between a position in which the valve member closes off the outlet and a position in which the outlet is open.

Preferably, the float element is connected to the sliding valve member by means of a pivoting lever, the float element and the sliding valve member being connected to opposed regions of the lever on opposite sides of the point about which the lever pivots.

Conveniently, the pivoting lever is a generally L-shaped lever mounted in the reservoir for pivotal movement about the joint between its two arms, the float element and the sliding valve member being mounted at the ends of the arms of the lever.

This invention also provides a photographic processing apparatus including a liquid transfer system as described above for transferring a photographic processing solution between a reservoir and a tank in the photographic processing apparatus.

In a second aspect this invention there is provided a method of transferring a liquid between a reservoir and a tank in a processing apparatus using a liquid transfer system, the method comprising the steps of connecting the reservoir outlet to the tank, pressurizing the reservoir so as to transfer liquid from the reservoir to the tank, and closing the reservoir outlet when the liquid level in the reservoir drops below a predetermined level.

Preferably, the reservoir is pressurized by connecting a space in the reservoir above the liquid to a supply of pressurized gas, the reservoir outlet being closed before all of the liquid has been transferred from the reservoir in order to prevent pressurized gas escaping from the reservoir.

Preferably, the reservoir outlet is closed by means of a valve arrangement incorporating a float element and movement of the float element acting to close the outlet when the liquid level in the reservoir drops below said predetermined level.

The method may additionally comprise the steps of reopening the reservoir outlet and transferring the liquid from the tank in the processing apparatus back to the reservoir.

The liquid may comprise a photographic processing chemical and the processing apparatus may comprise a photographic processing apparatus.

In order that the present invention may be more readily understood and so that further features thereof may be appreciated, the invention will now be described by way of example with reference to the accompanying drawings.

DETAILED DESCRIPTION OF THE DRAWINGS

The arrangements shown in the accompanying drawings will be described with reference to their use in connection with a photographic processing apparatus, but it is to be appreciated that the arrangements may well be used in other applications.

Figure 1:
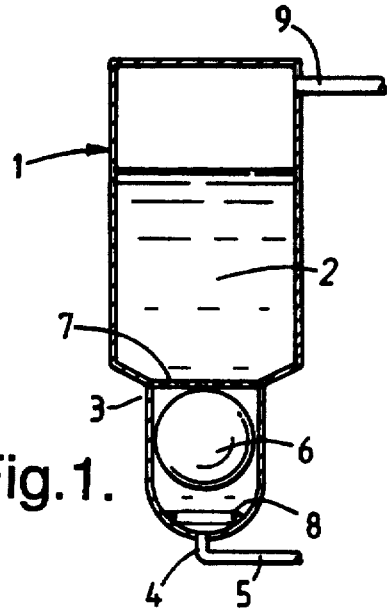
FIG. 1 is a schematic elevation of a first embodiment of a liquid transfer system according to this invention showing liquid being transferred from a reservoir forming part of the system.

Referring initially to FIG. 1 of the drawings, a liquid transfer system comprises a reservoir in the form of a rigid, airtight bottle 1 containing a photographic processing chemical 2. The bottle is formed with a neck 3 at one end, the neck 3 defining an outlet opening 4 to which a tube 5 is connected. At its other end the tube 5 is connectable to a tank in a photographic processing apparatus to which the chemical 2 is to be supplied. The neck 3 of the bottle incorporates a valve arrangement comprising a float in the form of a hollow sphere 6 which is held in the neck 3 by means of a grid 7, or the like, extending across the junction between the neck 3 and the main body of the bottle 1 and a sealing ring 8 which is located around the outlet opening 4. When there is sufficient liquid within the bottle 1 and the bottle is held vertically with the outlet at its lower end the float element 6 naturally rises within the neck 3 to engage the grid 7, i.e., the float element floats in the liquid.

At its upper end the bottle 1 is provided with a connection 9 through which a propellant is supplied into a space above the liquid within the bottle 1 in order to pressurize the space. Thus, the connection 9 may lead to a source of pressurized air, butane or any other suitable form of propellant.

The bottle 1 is supplied containing just enough processing solution to fill the tank to which it is connected in use, but not so much that the tank can overflow. When the processing solution 2 is to be transferred to the tank, the tube 5 is connected to the tank and the space above the solution 2 in the bottle is pressurized, via the connection 9, by way of the source of pressurized gas. The processing solution 2 is thereby forced past the float 6 and through the outlet 4, whereupon it passes along the tube 5 to the tank which is to be filled. There is, of course, sufficient clearance around the float 6 for the liquid to flow past the float and reach the outlet 4. As the liquid level falls within the bottle 1 there will come a point where the float 6 will start to drop down the neck 3 as it remains upon the surface of the liquid. Eventually the state shown in FIG. 2 will be reached where nearly, but not quite all of the liquid has been transferred from the reservoir and the float 6 engages the sealing ring 8 and closes the outlet 4.

It will be appreciated that the float 6 comes into engagement with the sealing ring 8 when there is still a very small amount of liquid left in the bottom of the neck 3 and the pressure within the bottle then serves to force the float 6 against the ring 8 so that a good seal is established and none of the gas which pressurizes the bottle 1 can escape from the bottle. This is of some importance because if, for example, pressurized air is pumped through the processing solutions in the tanks of the processing apparatus, this can oxidize the solution or cause frothing and can impair the processing operation.

When the processing solution is spent, or when it is to be replaced by a different solution, or when it is not to be used for a specific period of time, it can be returned to the bottle 1 by simply disconnecting or shutting off the pressurized gas supply so that the pressure is released from within the bottle. If the bottle 1 is located below the level of the tank in the photographic processing apparatus containing the solution, then the solution will drain back into the bottle 1 under the action of gravity. Alternatively, if the bottle 1 is positioned above the level of the tank in the processing apparatus, then the solution may be pumped back into the bottle 1. The tube 5 can then be disconnected from the tank and can be sealed off in any appropriate manner so that the solution in the bottle 1 can be safely stored until it is required again or can be transported for disposal or recycling.

It will be appreciated that the supply system described above represents a very simple and effective way of transferring liquid between a reservoir and a processing tank. The arrangement is self-limiting in that only sufficient liquid is provided in the reservoir to fill the tank. This avoids the need to provide limit switches to sense when the tank is full. The processing solutions themselves need never be handled directly by a user as they are supplied in the airtight reservoir 1 and are returned to the reservoir which is then sealed before the solution is disposed of or sent for recycling. It will be appreciated that a reservoir will be provided for each tank in a photographic processing apparatus and the connections 9 with each reservoir can lead to a single, inexpensive pressurized gas supply. The valve arrangement incorporating the float 6 represents a simple way of preventing pressurized air from being pumped through the processing solution and is automatically released or opened when the pressure is released from within the container.

Figure 3:
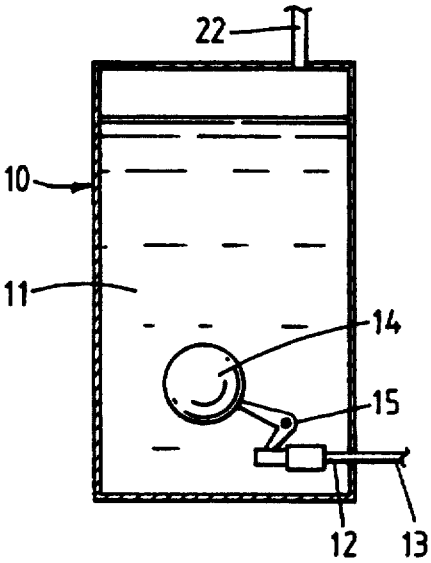
FIG. 3 is a schematic elevation of a second embodiment of a liquid transfer system according to this invention showing liquid being transferred from a reservoir forming part of the system.
Figure 5:
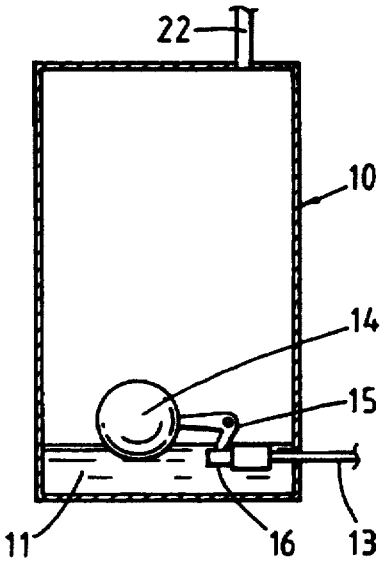
FIG. 5 is a view corresponding to FIG. 3, but showing the system when most of the liquid has been transferred from the reservoir.
Figure 4:
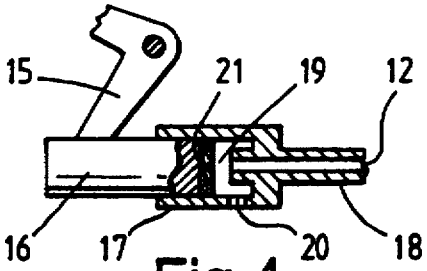
FIG. 4 is an enlarged view showing part of a valve arrangement of the system shown in FIG. 3.

FIGS. 3, 4, and 5 illustrate a slightly modified embodiment of a liquid transfer system which works in very much the same way as the arrangement described above. The system shown in FIGS. 3–5 again comprises a rigid, airtight reservoir 10 containing a photographic processing solution 11. At its lower end the reservoir 10 has an outlet 12 from which a tube 13 extends. The free end of the tube 13 is connectable to a tank in a photographic processing apparatus to which the solution 11 is to be supplied.

A valve arrangement is again associated with the outlet 12, the valve arrangement comprising a float in the form of a hollow sphere 14, the float being connected to the free end of one arm of a L-shaped pivoting lever 15. The lever 15 is mounted within the reservoir 10 for pivotal movement about the junction between its two arms. The other arm of the lever 15 is connected at its free end to a sliding valve member 16 which is constrained to move linearly within a housing 17. The housing 17 is formed with a tube or pipe 18, one end of which defines the outlet 12 from the reservoir 10. The tube 18 projects into a chamber 19 which is defined by the housing 17. One wall of the housing 17 is formed with an aperture 20 which leads into the chamber 19.

Processing solution 11 contained in the reservoir 10 may gain access to the chamber 19 by way of the aperture 20. The sliding valve member 16 is movable between an open position as shown in FIGS. 3 and 4 in which it is spaced from the end of the pipe 18 located within the chamber 19 and a closed position, as shown in FIG. 5, in which it engages and shuts off the end of the pipe 18 within the chamber 19. The end of the sliding valve member 16 which is received within the housing 17 is provided with a seal or washer 21 which forms a close fit within the housing and forms a good seal with the end of the pipe 18 when the valve arrangement is in the closed position.

The upper end of the reservoir 10 is again provided with a connection 22 which extends to a supply of pressurized gas adapted to pressurize the space above the processing solution 11 within the reservoir.

Figure 2:
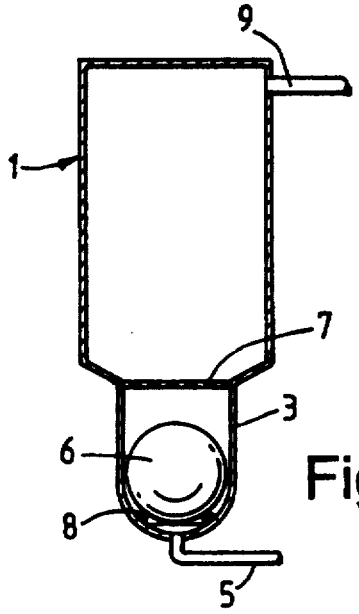
FIG. 2 is a view corresponding to FIG. 1, but showing the system when all of the liquid has been transferred from the reservoir.

As with the arrangement described in FIGS. 1 and 2, when the processing solution 11 is to be supplied to a tank in a photographic processing apparatus, the free end of the tube 13 is connected to the tank and the space in the reservoir 10 above the solution 11 is pressurized via the connection 22 by means of a pressurized air supply or the like. The processing solution 11 is thereby forced through the aperture 20 into the chamber 19 defined by the housing 17 and, as long as the float 14 remains in the elevated position and the sliding valve member 16 is spaced from the end of the tube 18 in the housing 17, the solution will pass along the tube 18 through the reservoir outlet 12 and along the tube 13 to the tank in the processing apparatus.

The float 14 naturally remains in an elevated position as shown in FIG. 3 until the level of processing solution drops to a point where the float will be positioned on the surface of the solution. The float will then drop as the level of the processing solution drops and the lever 15 will pivot in an anti-clockwise direction thereby causing the sliding valve member 16 to move to the right as seen in the accompanying drawings. Eventually the seal or washer 21 moves into engagement with the left hand end of the pipe 18 and serves to close off the pipe. The processing solution can no longer escape from the reservoir 1. It will be appreciated that with the outlet 12 located slightly above the lowermost end of the reservoir 10 a small amount of processing solution 11 remains within the reservoir when the valve arrangement is closed as shown in FIG. 5.

The reservoir 10 is only charged with sufficient processing solution 11 to just fill the tank which is to be supplied therefrom so that the arrangement is self-limiting and there is no risk of the tank overflowing. Once the solution has been transferred from the reservoir 10 to the tank in the processing apparatus the pressurized gas supply may be shut off or disconnected. Even if the reservoir is located below the level of the tank in the processing apparatus the solution will not flow back into the reservoir because the seal 21 on the end of the sliding valve member 16 remains seated against the end of the pipe 18.

While this arrangement enables the pressure supply to be switched off once the processing solution has been transferred to the processing apparatus, it is necessary to move the sliding valve member 16 to the left, as seen in the drawings, in order to return the processing solution from the tank to the reservoir. This movement of the member 16 may be affected by tilting or inverting the reservoir such that the float 14 moves to cause clockwise pivotal movement of the lever 15 thereby drawing the sliding valve member 16 away from the tube 18. Alternatively, movement of the sliding valve member 16 may be affected by lifting the float 14 by any other appropriate means, such as an electromagnetic arrangement or a suitable system of linkages.

Once the processing solution has been returned to the reservoir 10 the tube 13 can be disconnected from the tank in the processing apparatus and can be sealed off in any appropriate manner so that the solution can be stored or transported for disposal or recycling. It will be appreciated that apart from the difference in the valve arrangement provided at the outlet of the reservoir, the system illustrated in FIGS. 3, 4, and 5 is very much the same as that in FIGS. 1 and 2 and possesses all the other advantages set out above in relation to the system of FIGS. 1 and 2.

It is to be understood that various other changes and modifications may be made without departing from the scope of the present invention. The present invention being defined by the following claims.

Parts List

1 . . . bottle
2 . . . photographic processing chemical
3 . . . neck
4 . . . outlet opening
5 . . . tube
6 . . . hollow sphere/float
7 . . . grid
9 . . . connections
10 . . . airtight reservoir
11 . . . photographic processing solution
12 . . . outlet
13 . . . tube
14 . . . hollow sphere/float
15 . . . pivoting lever
16 . . . valve member
17 . . . housing
18 . . . tube or pipe
19 . . . chamber
20 . . . aperture
21 . . . seal or washer
22 . . . connection

We claim:

1. A liquid transfer system for transferring liquid between a reservoir and a tank in a processing apparatus, the system comprising a liquid reservoir, the reservoir having an outlet, means for connecting the reservoir outlet to a tank in a processing apparatus, means for pressurizing the reservoir to transfer liquid from the reservoir to the tank, the outlet of the reservoir being provided with a valve arrangement, the valve arrangement closing the reservoir outlet when the liquid level in the reservoir drops below a predetermined level.

2. A liquid transfer system according to claim 1 wherein the means for pressurizing the reservoir comprise a supply of pressurized gas connected to a space in the reservoir above the liquid contained therein, the pressurized gas supply forcing liquid from the reservoir, the valve arrangement acting to close the reservoir outlet before all of the liquid has been transferred from the reservoir thereby preventing pressurized gas from escaping from the reservoir.

3. A liquid transfer system according to claim 1 wherein the valve arrangement incorporates a float element, movement of the float element acting to close the reservoir outlet when the liquid level in the reservoir drops below said predetermined level.

4. A liquid transfer system according to claim 3 wherein the float element engages part of the reservoir outlet in order to close the outlet.

5. A liquid transfer system according to claim 4 wherein the outlet is surrounded by a sealing ring, the float element engaging the sealing ring to close the outlet.

6. A liquid transfer system according to claim 4 wherein the float element is held in position adjacent the outlet by a retaining grid mounted in the reservoir.

7. A liquid transfer system according to claim 3 wherein the float element is connected to a sliding valve member positioned adjacent the reservoir outlet, movement of the float element resulting in movement of the valve member between a position in which the valve member closes off the outlet and a position in which the outlet is open.

8. A liquid transfer system according to claim 7 wherein the float element is connected to the sliding valve member by means of a pivoting lever, the float element and the sliding valve member being connected to opposed regions of the lever on opposite sides of the point about which the lever pivots.

9. A liquid transfer system according to claim 8 wherein the pivoting lever is a generally L-shaped lever mounted in the reservoir for pivotal movement about the joint between its two arms, the float element and the sliding valve member being mounted at the ends of the arms of the lever.

10. A photographic processing apparatus including a liquid transfer system for transferring a photographic processing solution between a reservoir and a tank in the photographic processing apparatus, the system comprising a liquid reservoir, the reservoir having an outlet, means for connecting the reservoir outlet to a tank in a processing apparatus, means for pressurizing the reservoir to transfer liquid from the reservoir to the tank, the outlet of the reservoir being provided with a valve arrangement, the valve arrangement closing the reservoir outlet when the liquid level in the reservoir drops below a predetermined level.

11. A method of transferring a liquid between a reservoir and a tank in a processing apparatus using a liquid transfer system comprising a liquid reservoir, the reservoir having an outlet, means for connecting the reservoir outlet to a tank in a processing apparatus, means for pressurizing the reservoir to transfer liquid from the reservoir to the tank, the outlet of the reservoir being provided with a valve arrangement, the valve arrangement closing the reservoir outlet when the liquid level in the reservoir drops below a predetermined level, the method comprising the steps of:

connecting the reservoir outlet to the tank; and pressurizing the reservoir so as to transfer liquid from the reservoir to the tank and closing the reservoir outlet when the liquid level in the reservoir drops below a predetermined level.

12. A method according to claim 11 wherein the reservoir is pressurized by connecting a space in the reservoir above the liquid to a supply of pressurized gas, the reservoir outlet being closed before all of the liquid has been transferred from the reservoir in order to prevent pressurized gas escaping from the reservoir.

13. A method according to claim 11 wherein the reservoir outlet is closed by means of a valve arrangement incorporating a float element, movement of the float element acting to close the outlet when the liquid level in the reservoir drops below said predetermined level.

14. A method according to claim 11 wherein the method additionally comprises the steps of reopening the reservoir outlet and transferring the liquid from the tank in the processing apparatus back to the reservoir.

15. A method according to claim 11 wherein the liquid comprises a photographic processing chemical and the processing apparatus comprises a photographic processing apparatus.

* * * * *